US006718967B2

(12) United States Patent
Luther

(10) Patent No.: US 6,718,967 B2
(45) Date of Patent: Apr. 13, 2004

(54) WOK COOKING APPARATUS

(75) Inventor: Harold Edward Scott Luther, Dallas, TX (US)

(73) Assignee: P. F. Chang's China Bistro, Inc., Scottsdale, AZ (US)

( * ) Notice: Subject to any disclaimer, the term of this patent is extended or adjusted under 35 U.S.C. 154(b) by 0 days.

(21) Appl. No.: 10/035,910

(22) Filed: Dec. 28, 2001

(65) Prior Publication Data

US 2003/0121512 A1 Jul. 3, 2003

(51) Int. Cl.[7] ..... F24C 3/08; F24B 3/00
(52) U.S. Cl. ..... 126/40; 126/30; 126/50
(58) Field of Search ..... 126/30, 40, 50, 126/215

(56) References Cited

U.S. PATENT DOCUMENTS

| | | | | | |
|---|---|---|---|---|---|
| 3,610,179 | A | * | 10/1971 | Shaw et al. | 110/214 |
| 3,658,049 | A | * | 4/1972 | Gerber | 126/215 |
| 4,889,103 | A | * | 12/1989 | Fraioli | 126/92 AC |
| 5,044,352 | A | | 9/1991 | Lok | |
| 5,315,983 | A | * | 5/1994 | Law | 126/216 |
| 5,775,316 | A | | 7/1998 | Jones | |
| 5,797,386 | A | * | 8/1998 | Orr | 126/25 R |
| 6,098,611 | A | * | 8/2000 | Fillmore | 126/50 |
| 6,186,055 | B1 | * | 2/2001 | DeMars et al. | 99/340 |

FOREIGN PATENT DOCUMENTS

GB 2 151 771 7/1985

OTHER PUBLICATIONS

Encyclopedia.com—Results for "olivine" Encyclopedia.com, http://www.encyclopedia.com/articles/34567.html, 2 pgs.

"Olivine", Microsoft® Encarta® Online Encyclopedia 2000 http://encarta.msm.com© 1997–2000 Microsoft Corporation. 1 pg.

American Minerals Profile, http://www.americanminerals.net/profile.html.

American Minerals Products, http://www.americanminerals.net/products.html.

Sieve Analysis 0–3, Industrimineraler AS, Olivine Products, Raubergvika—Norway, http://www.industrimineraler.no/sieve0–3.htm, 2 pgs.

Products Page, Industrimineraler AS, Olivine Products, Raubergvika—Norway, http://www.industrimineraler.no/products.htm, 1 pg.

0–3 mm, Industrimineraler AS, Olivine Products, Raubergvika—Norway, http://www.industrimineraler.no/prod01.htm, 1 pg.

10–30mm, Industrimineraler AS, Olivine Products, Raubergvika, Norway, http://www.industrimineraler.no/prod02.htm, 2 pgs.

Town Food Service Equipment Company, Inc., http://www.townfood.com/index2.htm, 1 pg.

Ranges and Smokehouses, http://www.townfood.com/rangehead.htm, 2 pgs.

Town Food—Smokehouses and Ranges, http://www.townfood.com/rangeframe.htm, 1 pg.

Dragon Descriptions 2, http://www.townfood.com/Drogondesc2.htm, 2 pgs.

Dragon Description 3, http://www.townfood.com/Dragondesc3.htm, 1 pg.

* cited by examiner

*Primary Examiner*—Alfred Basichas
(74) *Attorney, Agent, or Firm*—Gray Cary Ware & Freidenrich

(57) ABSTRACT

A wok support for use in a wok range incorporates a refractory insulating material into its structure. The wok support includes a tubular support structure having internal space in its wall. The refractory insulating material is disposed in the internal space.

36 Claims, 4 Drawing Sheets

WOK COOKING APPARATUS

BACKGROUND OF THE INVENTION

The invention is in the field of high-temperature cooking and particularly concerns wok cooking apparatus, such as wok ranges and wok support structures that incorporate a refractory insulating material. From another aspect, the invention concerns a wok support structure that includes a refractory insulating material to reduce the amount of heat conducted through the structure.

Wok cooking involves the application of intense heat to a wok, a metal cooking pan with a convex bottom. Typically, the heat is applied from a gas burner. High-volume wok cooking as might occur in a restaurant, for example, may employ a wok range with multiple wok cooking stations. In a wok range, a wok cooking station usually consists of a cylindrical or tubular wok support that rises from a heat source such as a gas burner, through a table bed that is penetrated by all of the wok cooking stations of the range. The table bed provides a surface that supports a flow of water used to clean woks between uses and also to conduct heat away from the wok supports.

Heat conduction by the table bed is an inevitable consequence of the operation of a wok range. Wok cooking is performed at temperatures ranging through 2,100° F. in order to encapsulate the flavor of the food being cooked and to bond spices and accents to the food. At each wok cooking station, the heat is chimneyed upwardly through a wok support to a wok. A significant amount of the heat provided by way of a wok support is conducted through the support to the table bed. As a consequence, the table bed of a wok range bears an enormous load of heat while the range is in use. Nor is the load continuous. During a busy day the wok cooking stations of a restaurant wok range are cycled on and off many times. In the typical range, hot spots occur between each wok cooking station and the table bed. The result is acceleration of fatigue and warping of the bed. This reduces the lifetime of a wok range and increases the facilities expense of a wok cooking restaurant. Presently, the problem of heat damage is solved by the application of water directly to the table bed. Dissipation of heat by a constant flow of water over the table bed and against the wok supports extends the lifetime of a wok range by reducing the rates of fatigue and warping.

Water flow in the operation of a wok range, however, raises resource, regulatory and economic issues. Because a wok range is in virtually constant use during the working day of a restaurant, water continuously washes over the table bed, past the wok supports. Because it is also used for cleaning, such water is typically not recycled. Thus, wok cooking can add substantially to the total amount of water consumed in the operation of a restaurant with a high daily volume of business (a "high volume" restaurant).

In a high volume restaurant, a large amount of water is consumed in the making of ice, the operation of sinks and toilets, the preparation of food, the serving of beverages, the washing of dishes and cooking implements, and the maintenance of landscaping; call this a "base consumption" amount. For example, in one high volume restaurant operated by the assignee of this application the base consumption of water was just under 10,000 gallons per day (gpd). In the same restaurant, when the amount of water consumed by high-volume wok cooking conducted on a range with four cooking stations was added, total water consumption, including the base consumption rate and the rate of consumption by the wok range, rose to 25,000 gallons/day (gpd). The installation of pressure regulators and precision valves at the faucets that feed the wok ranges reduced the total consumption rate to 13,000 gpd. This would appear to be a very satisfactory result. Nevertheless, it is anticipated that further reductions will soon be needed. Since the easy and obvious solutions to reducing water consumption are already in use, novel technical advances will be required to achieve additional reduction.

In the United States, there is a growing trend to limit water use by regulation. A number of local and state jurisdictions are considering the regulation by law of commercial and residential water consumption. Proposed ordinances and legislation would set a limit on use and impose penalties for excess consumption. Shut-off of service is one possible penalty. Such a measure would, of course, spell economic disaster for a restaurant.

Finally, the cost of water is rising inexorably. Therefore, in a high volume restaurant, every measure taken to reduce the use of water limits the operating expense resulting from its cost. This is an especially pressing economic consideration in the balance sheet of a high-volume restaurant serving wok-cooked cuisine.

Presume that a target for the total consumption rate of a high-volume restaurant with a multi-station wok range is between 8,000 gpd and 10,000 gpd. Even with the implementation of available water flow control measures, the four station range configuration described above, at 13,000 gpd, fails to meet the target. Accordingly, there is still a distinct and substantial problem in controlling the amount of water consumed in the operation of such wok ranges. The failure to achieve further reductions in the consumption of water and fuel can directly and adversely affect the profitability and competitive ability of a high volume restaurant offering wok-cooked cuisine.

The problem may also be viewed from another aspect. The heat to be dissipated in a wok range emanates principally from the wok supports at the cooking stations. These elements are constructed to support a wok above the table bed and to transfer heat upwardly from a gas burner to the wok. Typically a wok support is made of a sturdy, durable material that tolerates long exposure to high temperatures without significant degradation in its ability to support a heavy wok containing a dense load of cooking food. In this regard, an exemplary wok support includes one or more cylinders of stainless steel that transfer heat not only upwardly to a wok, but also laterally, through the support structure itself, to the table bed. This not only increases the consumption of water needed to cool the table bed, it also increases the amount of fuel necessary to cook food in the wok. With reduction of the transfer of heat to the table bed, the consumption of both water and fuel would be reduced. Thus, there is a distinct and substantial problem in the highly heat conductive characteristic of a wok support.

SUMMARY OF THE INVENTION

The problem of water usage in a wok range with a table bed for supporting a flow of water to conduct heat and the problem of heat conduction through a wok support are solved by the invention which provides a novel structure for a wok support that incorporates a refractory insulating material into the structure of the wok support. According to the invention, a wok support includes a tubular support structure having internal space in its wall. The refractory insulating material is disposed in the internal space. When a wok support thus constructed is received in a range to support a wok over a heat source, the amount of heat transferred laterally through the wall is substantially less than the amount of heat transferred laterally through the wall of a tubular wok support without a refractory insulating material integrated into its structure. Consequently, when disposed at the wok stations of a wok range, a plurality of wok supports constructed with refractive insulating material significantly reduce the volume of water necessary to cool the table bed and the amount of fuel necessary to cook, and produce hydrological and fuel resource savings. Since the invention constrains heat load on the table bed, these savings will not be bought with a shortened range lifetime. As a consequence, enhanced profitability and amplified competitive advantage will be realized by a high volume restaurant utilizing a wok range with wok supports constructed according to the invention.

DETAILED DESCRIPTION OF THE PREFERRED EMBODIMENTS

The description to follow sets forth the principles of the invention with reference to embodiments that have been selected to instruct the reasonably skilled artisan as to a representative application of those principles which achieves solutions to the problems set forth above. These embodiments are only intended to illustrate the invention. In fact, the invention may be applied or practiced in many other embodiments.

In the following description, the term "heat transfer" is employed with respect to various elements. This use is not intended to refer to any single heat transfer mechanism to the exclusion of any other. In this regard, "heat transfer" may mean any one or more of conduction, radiation, and convection. Further the total amount of heat transferred by any element to be described may result from varying contributions from these heat transfer mechanisms.

The term "refractory insulating material" is also used in this description. The term denotes a material that is both refractory and insulating, that is, a material that is difficult to melt (at least at the temperature at which a wok range is operated) and that prevents, blocks, reduces, or retards the passage of heat into or out of something.

Figure 1:
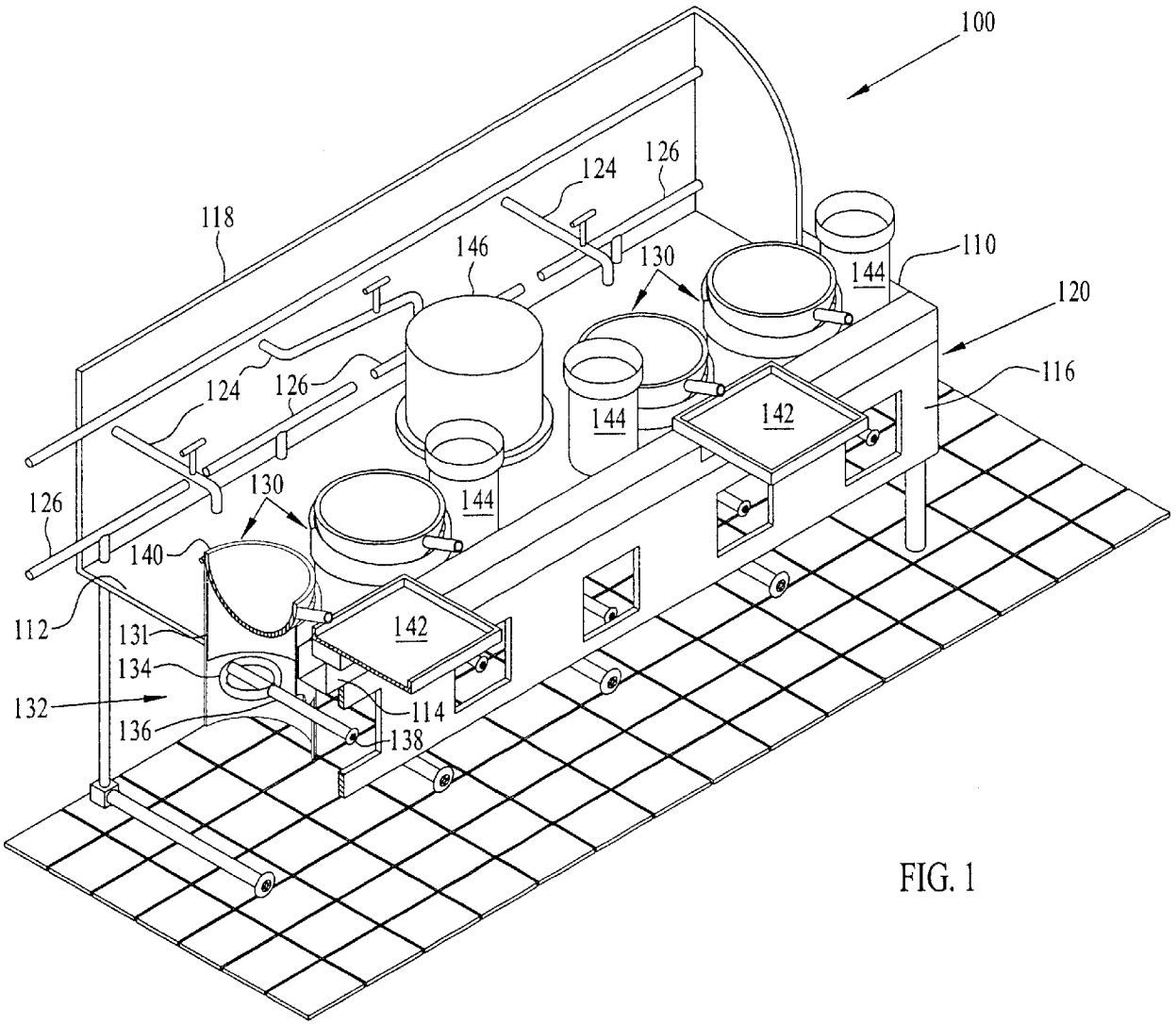
FIG. 1 is a partially schematic, perspective view of a wok range according to the invention.

Refer now to FIG. 1 which illustrates a wok range that incorporates the principles of the invention. The wok range (also simply "range") 100 includes a frame 110. One element supported by the frame 110 is a table bed 112, essentially a continuous sheet of material, typically steel, that transitions, at its front edge, to a trough 114. Outside of the trough 114, the frame 110 includes a front panel 116, a back panel 118, and two side panels, one indicated by reference numeral 120 and the other cut away to show internal features of the range. The four panels 116, 118, 120 are attached to the table bed 112 in order to confine a flow of water thereon. The flow of water originates at faucets 124 and spray bars 126, and is collected and conducted away from the table bed 112 via the trough 114 to a collection and disposal means that is not shown.

There are four cooking stations 130 in the example of FIG. 1, although this number is not intended to limit the invention. Each cooking station 130 penetrates the table bed 112 through an opening 131 in the table bed. In this example, the openings 131 are circular. A cooking station is typically manned by a chef who utilizes a wok at the cooking station to prepare food. Each cooking station 130 includes a wok support 132, and a gas burner 134. A wok support 132 is received in an opening 131 and supported therein by means that are not shown in FIG. 1, with one end portion extending above the table bed 112 and another end portion disposed below the table bed. A gas burner 134 is disposed and supported in each wok support 132 and is fed a flow of gas by way of a gas pipe 136. A valve 138 is provided on each gas pipe to control the flow of gas therethrough to burner. Conventional ignition means for each burner are not shown. Each wok support 132 supports a wok 140, and chimneys heat upwardly from a gas burner 134 to the wok.

The wok range 100 has a conduit tray 142 positioned between adjacent cooking stations 130 to provide a surface accessible to chefs at adjacent cooking stations on which condiments and ingredients for cooking may be stationed. Cans 144 contain cooking oil and a pot 146 contains stock. In this example, both the cans 144 and the stock pot 146 are hollow cylindrical containers, each with one closed end, that are supported on the table bed 112.

In operation, any one or more of the cooking stations 130 is used by a chef to cook food in a wok. The condiment trays 142, the cooking oil cans 144, and the stock pot 146 conveniently station common and frequently-used ingredients near each cooking station 130. The heat transferred by the wok supports 132 from the burners 134 flows upwardly toward the woks 140 and also laterally or transversely to the table bed 112. During operation water flows steadily and continuously from the faucets 124 and spray bars 126 over the table bed 112 to the trough 114. The water flows off of the table bed 112 by way of the trough 114 whence it is collected and disposed of. The water is used to clean woks between uses and, heretofore, also to cool the table bed 112 and the wok supports 130 by absorbing heat and conducting it away from the bed and the supports.

Figure 2:
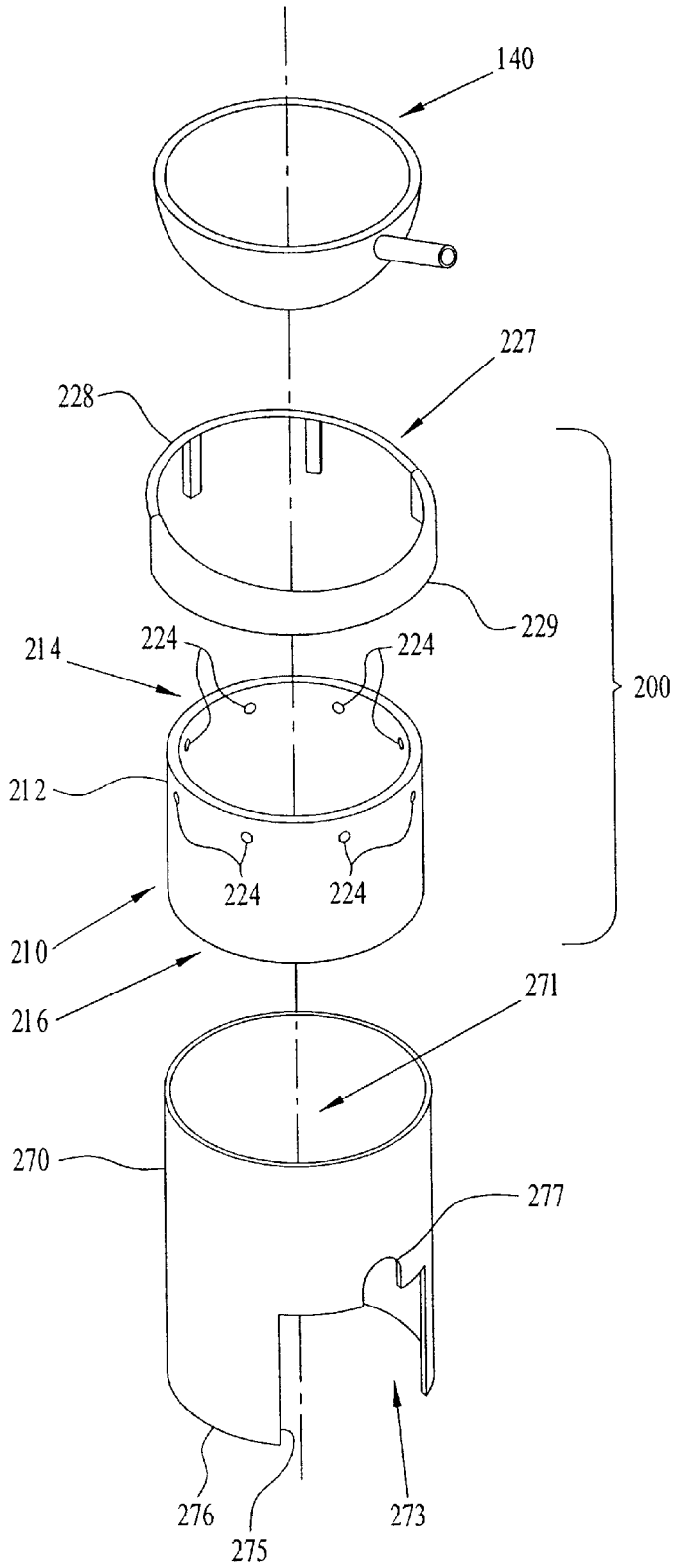
FIG. 2 is an exploded view of a wok support embodiment useful for illustrating the invention
Figure 3:
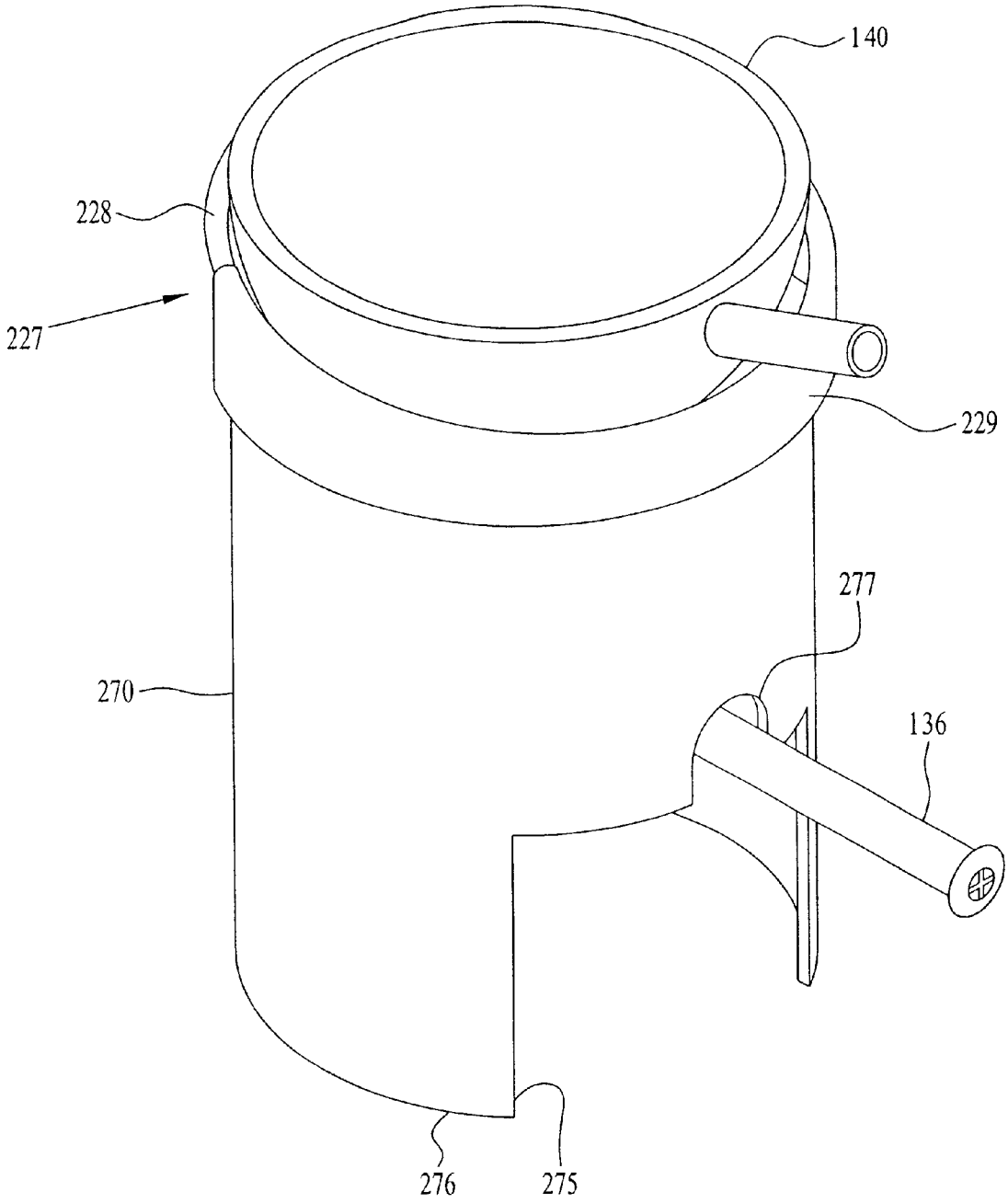
FIG. 3 is a side perspective view of the assembled wok support embodiment of FIG. 2.
Figure 4:
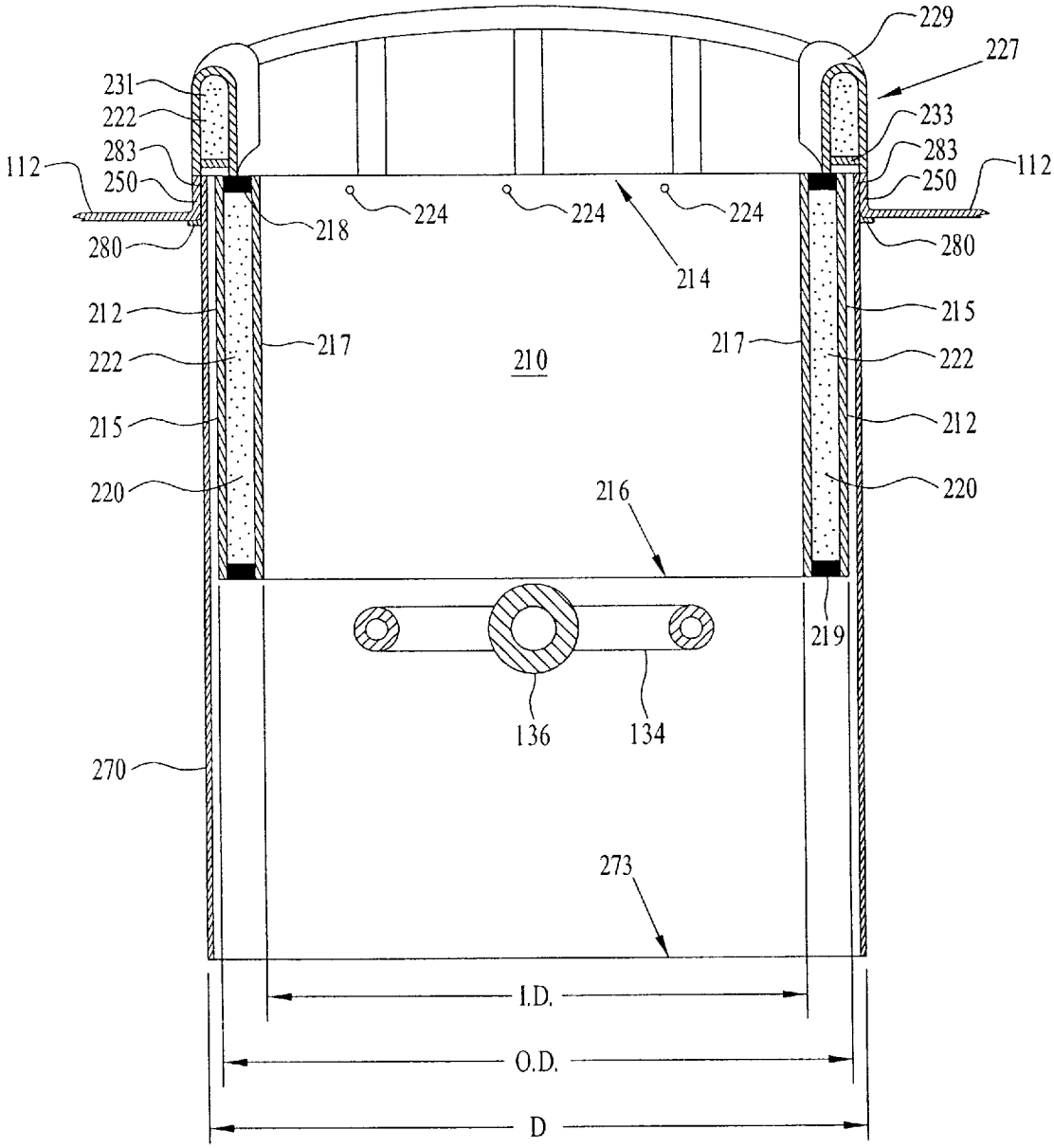
FIG. 4 is the side elevation view of the embodiment of FIG. 3, in section to illustrate the principles of the invention.

Refer to FIGS. 2–4 in which one instructive example of a wok support according to the invention is shown. This embodiment is presented and described only for the purpose of illustrating the invention; there are, in fact, other embodiments that can be designed which adapt the invention to various support and/or range configurations. In these figures, the wok support embodiment 200 includes a tubular structure 210 in the form of a hollow cylindrical section having a wall 212, and two open ends 214 and 216. In this embodiment, the tubular structure 210 is formed by two concentrically-disposed cylinders 215 and 217, the outer cylinder 215 having a diameter (OD) slightly larger than the diameter (ID) of the inner cylinder 217. Flat annular rings 218 and 219 join the inner and outer cylinders at the perimeters of the ends 214 and 216 (by being welded thereto, for example) and close the space between them. As a result, an internal space 220 is formed in the tubular structure 210. In this embodiment, the internal space is in the form of a hollow cylinder, or an elongated, continuous annulus, although this is not necessary to, or intended to limit the invention. The internal space 220 has disposed in it a refractory insulating material 222. The internal space 220 and the insulating material are positioned in the tubular structure 210 at least where the structure interfaces with, or otherwise contacts the table bed 112 when positioned in the wok range 100. Preferably, the internal space 220 and the refractory insulating material 222 extend longitudinally in the tubular structure 210 at least up to the level of the table bed 112, when the structure is received in the table bed. One or more vent holes 224 near the open end 214 open into the internal space 220 from one or more of the outside surfaces of the tubular structure 210.

At least one end of the tubular structure 210 is adapted to receive and support a wok crown 227. For example, the end 214 of the tubular structure 210 may be so adapted. In this case, the adaptation is the provision of the upper ring 218 to which the wok crown 227 may be attached. The wok crown 227 is a ring-like structure that, in this embodiment, is adapted to support the concave shape of a wok. The crown 227 has a wok ring 228 integrated structurally with an arcuate section 229. An internal space 231 is provided in the arcuate section 229. The refractory insulating material 222 is also disposed in the internal space 231. The bottom of the arcuate section 229 is closed by an arcuate ring 233.

Preferably, the elements of the tubular structure 210 and the wok crown 227 are made of a hardy heat-tolerant metal such as ten gage type 304 corrosion resistant steel (CRES), annealed, and passivated, with a milled finish. The elements are conventionally handled and joined when the tubular structure 210 and the wok crown 227 are being assembled. In a final assembly step, the arcuate section 229 may be welded to the ring 218 at the end 214 of the tubular section 210.

The refractory insulating material 222 is a material that resists melting or changing in composition, phase, or form when exposed to the operating temperatures encountered in the operation of a wok range, which can exceed 2000° F. The material also resists, retards, or otherwise reduces the transfer of heat through itself and therefore through the structures that it is disposed in. Initially, it would seem that there are many materials, mixtures, and/or compositions that would meet these conditions. However, there are also conditions of easy incorporation into conventional methods for manufacturing wok range components, health, safety, stability, availability, and economy that must also be taken into account when the selection of the material is made. There are such materials available in granular or particulate form: non-silica foundry sand and ceramic grit material are but two examples. (In this regard, "non-silica foundry sand" is foundry sand that is, if not entirely free of silica (quartz), then possessed of a low enough concentration of silica to meet relevant standards limiting use of the material in food handling and preparation equipment.) One refractory insulating material that is effective in achieving the objectives of this invention and is also available, reasonably priced, non-toxic, safe, stable and very easy to handle during wok range manufacture is olivine in particulate, powdered or granular form, preferably with an average grain or particle size in the range of about 50 screen to 80 screen. In this form, the refractory insulating material 222 may be poured into the internal spaces 220 and 231 as these spaces evolve during the construction of the tubular and arcuate sections 210 and 229, collecting therein until the spaces are filled, at which time the spaces are closed by a final assembly step. Before or during the final assembly steps, the granular or particulate form of the refractory insulating material 222 may be bound, if desired. The refractory insulating material may also be bound, cast, sintered or otherwise formed into a free standing structure with an appropriate shape before being placed in the internal spaces 220 and 231. It should also be apparent that the refractory insulating material may be mixed or combined with other materials selected to enhance or modify the refractory and insulating properties of the material and/or to achieve other design goals.

Manifestly, as the tubular structure and the refractory insulating material are heated and cooled these elements will expand and contract to different degrees and at different rates. Also, moisture that may be found in the internal spaces 220 and 231 will expand when heated. The one or more vent holes 224 are provided to relieve stresses and pressure within the internal spaces 220 and 231 resulting from these conditions. These are optional, of course, as strictly controlled manufacturing methods and careful selection of materials may also reduce or eliminate these conditions.

As illustrated in FIGS. 2–4, an outer cylinder 270 may be provided. The outer cylinder 270 is a singled-walled hollow cylinder with two open ends 271 and 273. The outer cylinder is adapted to accommodate a gas burner 134. For example, a portion of the outer cylinder 270 may be cut away at 275, with the cut extending from one edge 276 to approximately the longitudinal middle of the cylinder 270. In this example, the cut away portion 275 transitions to a notch 277. The notch 277 receives the gas pipe 136 that feeds fuel to the gas burner 134. The outer cylinder's diameter D is slightly larger than OD in order that the tubular structure 210 may be received in the outer cylinder 270, just above a gas burner 134, with the portion of the tubular structure 210 that supports the crown 227 extending out of the end 271. The outer cylinder may be made of the same CRES material as the tubular structure 210.

The outer cylinder 270 is concentrically aligned with the opening 131 and welded at its end 271 to the underside of the table bed 112. The weld is indicated by 280 in FIG. 4. In this position, the outer cylinder 270 acts as a flame shield by substantially enclosing the burner 134. The burner 134 may be supported in the outer cylinder 270 by conventional means such as welded supports. As seen in FIG. 4, at each opening 131 the table bed 112 transitions to a raised circular collar or rim 250 on which a wok support is received. In addition to supporting a wok support, the raised circular rim 250 also acts to prevent water on the table from flowing through the opening 131. The tubular structure 210, with the wok crown welded to it is received, end 216 first, through the opening 131 of the table bed 112 and slid therethrough until the bottom outside edge 283 of the arcuate section 239 engages the raised circular rim 250 surrounding the opening 131. The tubular structure 210 and wok crown 227 are supported on the table bed 112 by the engagement of the edge 283 and the rim 250; the engagement can be enhanced by welding the edge 283 to the upper edge of the rim 250.

In the operation of the wok range and wok support structure, a wok is received on the wok crown 227. The burner 134 is lit, and heat is transferred from the burner upwardly through the tubular structure 210 to the bottom of the wok. As can be appreciated, the thermal pathway through the outer cylinder 270 is one principal means by which heat may be transferred to the table bed 112. However, with the tubular structure 210 insulated as described, much less heat is transferred to the table bed by way of the outer cylinder than would otherwise be the case. In this regard, the refractory insulating material 222 resists the transfer of heat laterally through the wall 212 of the tubular structure to the outer cylinder 270. Further, the arcuate section of the wok crown 227 directly contacts the raised edge 283 of the table bed 112. Here, the disposition of the refractory insulating material in the internal space 231 reduces the amount of heat transferred from the wok crown to the table bed 112.

I Claim:

1. A wok support, comprising:

a tubular structure with a wall and two ends;

a wok crown received on the one end, the wok crown having an arcuate section receivable on the end, an internal space in the arcuate section, and a refractory insulating material disposed in the internal space of the arcuate section;

an internal space in the wall; and, a refractory insulating material disposed in the internal space.

2. The wok support of claim 1, the tubular structure being a hollow cylinder in which the wall has an inner wall and an outer wall and at least two annular rings extending between the inner wall and outer wall such that the inner wall, the outer wall, and the two annular rings define the internal space.

3. The wok support of claim 2, the two annular rings each being continuous.

4. The wok support of claim 1, the internal space being an annular volume of space disposed in the wall.

5. The wok support of claims 1, 2, or 4 in combination with an outer cylinder having a wall and two ends, one end adapted to receive the tubular structure partially disposed therein, and the wall including an opening to accommodate a gas burner pipe.

6. The wok support of claims 1, 2, or 4 wherein the refractory insulating material comprises a non-silica foundry sand.

7. The wok support of claims 1, 2, or 4 wherein the refractory insulating material comprises olivine.

8. The wok support of claim 7, wherein the olivine has a particle size in the range of about 50 screen to about 80 screen.

9. The wok support of claims 1 or 8, further including one or more vent holes opening to the internal space in the wall of the tubular structure.

10. The wok support of claim 1, in combination with an outer cylinder having a wall and two ends, one end adapted to receive the tubular structure partially disposed therein, and the wall including an opening for accommodating a gas burner pipe.

11. The wok support of claim 1 wherein the refractory insulating material comprises a non-silica foundry sand.

12. The wok support of claim 1, wherein the refractory insulating material comprises olivine.

13. The wok support of claim 12, wherein the olivine has a particle size in the range of about 50 screen to about 80 screen.

14. The wok support of claim 13, further including one or more vent holes opening into the wall of the tubular structure.

15. A combination for use in a wok range, comprising:

a first hollow cylindrical structure having a wall with a thickness and two ends;

an annular internal space in the wall;

a refractory insulating material in the internal space;

a wok crown received on one end, the wok crown having an arcuate section receivable on the end, an internal space in the arcuate section, and a refractory insulating material disposed in the internal space of the arcuate section;

a second hollow cylindrical structure having a wall and two ends, for receiving the first hollow cylindrical structure; and, an opening in the wall of the second hollow cylindrical structure for receiving a gas pipe.

16. The combination of claim 15, further including one or more vent openings in the wall of the first hollow cylindrical structure.

17. The combination of claim 15, wherein the refractory insulating material includes a non-silica foundry sand.

18. The combination of claim 15, wherein the refractory insulating material includes olivine.

19. The combination of claim 18, wherein the olivine has a particle size in the range of about 50 screen to about 80 screen.

20. The combination of claim 15, further including an internal space in the crown and the refractory insulating material in the internal space of the crown.

21. The combination of claim 20, wherein the refractory insulating material includes a non-silica foundry sand.

22. The combination of claim 20, wherein the refractory insulating material includes olivine.

23. The combination of claim 22, wherein the olivine has a particle size in the range of about 50 screen to about 80 screen.

24. A wok range, comprising:

a frame;

a table bed supported in the frame;

one or more wok supports extending through the table bed, each wok support including an end for supporting a wok above the table bed, a wok crown received on the one end, the wok crown having an arcuate section receivable on the end, an internal space in the arcuate section, and a refractory insulating material disposed in the internal space of the arcuate section; and an end for engaging a heat source below the table bed;

an internal space in each wok support; and a refractory insulating material disposed in the internal space of each wok support.

25. The wok range of claim 24, wherein the refractory insulating material includes a non-silica foundry sand.

26. The wok range of claim 24, wherein the refractory insulating material includes olivine.

27. The wok range of claim 26, wherein the olivine has a particle size in the range of about 50 screen to about 80 screen.

28. The wok range of claim 24, wherein each wok support includes:

a first hollow cylindrical structure having a wall with a thickness and two ends;

an annular internal space in the wall;

the refractory insulating material being disposed in the annular internal space;

a second hollow cylindrical structure having a wall and two ends, for receiving the first hollow cylindrical structure; and, an opening in the wall of the second hollow cylindrical structure for receiving a gas pipe.

29. The wok range of claim 28, further including one or more vent openings in the wall of the first hollow cylindrical structure.

30. The wok range of claim 28, wherein the refractory insulating material includes a non-silica foundry sand.

31. The wok range of claim 28, wherein the refractory insulating material includes olivine.

32. The wok range of claim 31, wherein the olivine has a particle size in the range of about 50 screen to about 80 screen.

33. The wok range of claim 28, further including an internal space in the crown and the refractory insulating material being disposed in the internal space of the crown.

34. The wok range of claim 33, wherein the refractory insulating material includes a non-silica foundry sand.

35. The wok range of claim 33, wherein the refractory insulating material includes olivine.

36. The wok range of claim 35, wherein the olivine has a particle size in the range of about 50 screen to about 80 screen.

* * * * *